US006457845B1

(12) United States Patent
Collins et al.

(10) Patent No.: US 6,457,845 B1
(45) Date of Patent: Oct. 1, 2002

(54) LUMINAIRE INCORPORATING CONTAINMENT IN THE EVENT OF NON-PASSIVE FAILURE OF HIGH INTENSITY DISCHARGE LAMP

(75) Inventors: Byron R. Collins, Tuxedo, NC (US); Chang Wei, Niskayuna, NY (US); Mao Chen, Evansville, IN (US)

(73) Assignee: General Electric Company, Schenectady, NY (US)

( * ) Notice: Subject to any disclaimer, the term of this patent is extended or adjusted under 35 U.S.C. 154(b) by 97 days.

(21) Appl. No.: 09/684,178

(22) Filed: Oct. 6, 2000

(51) Int. Cl.[7] ..... F21V 15/00; F21V 3/04
(52) U.S. Cl. ..... 362/311; 362/326
(58) Field of Search ..... 362/311, 326, 362/329, 362

(56) References Cited

U.S. PATENT DOCUMENTS

| | | | | |
|---|---|---|---|---|
| 4,489,367 A | * | 12/1984 | Herron et al. | 362/311 |
| 5,143,446 A | | 9/1992 | Barnes et al. | 362/293 |
| 5,391,795 A | | 2/1995 | Pickett | 556/436 |
| 5,457,164 A | | 10/1995 | Wilkie | 525/367 |
| 5,679,820 A | | 10/1997 | Pickett et al. | 556/436 |
| 5,882,108 A | * | 3/1999 | Fraizer | 362/293 |
| 5,931,566 A | * | 8/1999 | Fraizer | 362/510 |
| 6,105,334 A | | 5/2000 | Monson et al. | 52/741.3 |
| 6,261,664 B1 | * | 7/2001 | Beeson et al. | 362/355 |
| 2001/0055215 A1 | * | 12/2001 | Fraizer | 362/509 |

FOREIGN PATENT DOCUMENTS

| | | |
|---|---|---|
| EP | 0574543 B1 | 7/2000 |
| JP | 09080203 A | 3/1997 |

OTHER PUBLICATIONS

Kemper Insurance Bulletin, "High Intensity Discharge (HID) Lighting Metal Halide Lamps," Oct., 1998.

* cited by examiner

*Primary Examiner*—Laura K. Tso
(74) *Attorney, Agent, or Firm*—Fay, Sharpe, Fagan, Minnich & McKee, LLP

(57) ABSTRACT

A metal halide gas discharge lamp (12) luminaire (10) includes an acrylic lens (22). The metal halide lamp (12) is subject to non-passive failure whereby not particles of quartz or ceramic arc tube (28) material and tungsten electrode (32, 34) material fall as hot (e.g. 1100 ° C.) debris. The interior, upper surface (24) of the lens (22) is ignition-resistant and, in exemplary embodiments, comprises a thin coating (44). In the event of non-passive failure of the lamp (12), hot debris particles fall on to the acrylic lens (22). Not only is there no flame, but hot debris particles do not sink into the material of the acrylic lens. Thus, containment is maintained.

32 Claims, 2 Drawing Sheets

LUMINAIRE INCORPORATING CONTAINMENT IN THE EVENT OF NON-PASSIVE FAILURE OF HIGH INTENSITY DISCHARGE LAMP

BACKGROUND OF THE INVENTION

The invention relates generally to high intensity discharge lamp luminaires and, more particularly, to luminaires including metal halide lamps that are susceptible to non-passive failure.

Metal halide gas discharge lamps have a number of desirable characteristics, including a good color balance suitable for indoor lighting (in contrast to mercury vapor and sodium lamps), and relatively efficient operation. They are widely used in many applications such as industrial lighting and sports lighting.

Metal halide lamps however can present a potential ignition problem. High intensity discharge lamps in general include a quartz or ceramic arc tube with a gaseous fill, and a pair of tungsten electrons located inside the arc tube at opposite ends. An arc between the electrodes emits visible light. In the case of a metal halide high intensity discharge lamp, the pressure inside the arc tube may reach 440 psi (30 bar), and the temperature may reach 1100° C. Metal halide lamps are subject to non-passive failure whereby hot particles of quartz or ceramic arc tube and tungsten electrode materials fall as hot debris, potentially igniting flammable objects below. Some metal halide lamp luminaires include a containment barrier for hot debris in the event of non-passive failure.

Thus, one general type of metal halide lamp luminaire takes the form of a lamp enclosure including a reflector having an open end oriented generally downwardly, and a transparent closure covering the open end. The transparent closure is conventionally referred to as a lens or refractor. As employed herein, the conventional term "lens" is not intended to be limited to a transparent closure with refractive qualities. However, in most cases, in order to produce a controlled lighting pattern, the lens has a prismatic interior (upper) surface, a prismatic exterior (lower) surface, or both, for reflecting and refracting light from the lamp.

In many respects, a good lens material is a transparent polymeric material such as acrylic polymer. Acrylic polymer is lightweight, transparent, and readily molded. It is relatively resistant to yellowing, particularly if an ultraviolet filter is employed to reduce the amount of ultraviolet radiation from the lamp reaching the acrylic resin material itself.

A disadvantage, however, of acrylic resin is that it is both flammable and thermoplastic, and subject to ignition and even melt-through by hot debris in the event of non-passive failure of a metal halide lamp.

There is an Underwriters Laboratory standard on containment, number UL1572, which has been updated to UL1598. In a containment barrier test pursuant to UL1572, a sample section of acrylic lens material is heated up to 88° C., which is the maximum expected nominal use temperature for one particular manufacturer. A surface located 12 inches (30.48 cm) below the acrylic lens sample is covered by a layer of dry absorbent cotton that is 0.25 inch (6.35 mm) thick. Quartz particles heated up to 1100° C. are dropped on to the acrylic lens. In most cases, the acrylic lens ignites, and the particle sinks into the acrylic lens. Failure is defined as the cotton being ignited by flaming drips of plastic material or any quartz particle that penetrates the acrylic lens material and falls on the cotton.

In order to provide sufficient containment, acrylic lenses are typically made relatively thick, for example 0.110 inches (2.794 mm) as a minimum, which has the disadvantages of adding to the cost and increasing the loss of light.

Another approach to containment which has been employed in the past is to place a layer of fiberglass on the upper refractor surface. In that prior approach, a circular piece of fiberglass sheet is cut out and attached to the upper relatively flat surface of the refractor or lens. The fiberglass sheet separates the acrylic from the hot particles, but reduces the light output of the luminaire by over 10%, and changes the light distribution pattern.

Yet another approach is to employ a transparent closure which is made of glass. While not subject to combustion, glass has disadvantages in that it is relatively heavy, is subject to shattering, and it is difficult to form prismatic surfaces having sharp edges in the case of a glass lens. A hybrid prior art approach is to employ a piece of glass above an acrylic refractor. In addition to the disadvantage of added cost, luminaire light output is reduced.

BRIEF SUMMARY OF THE INVENTION

It is therefore seen to be desirable to improve the containment of hot debris in the event of non-passive failure of a metal halide gas discharge lamp in a luminaire including an acrylic lens.

It is further seen to be desirable to reduce the cost of an acrylic lens or refractor, and to increase luminaire light output, by decreasing the thickness of the acrylic lens.

In an exemplary embodiment of the invention, a luminaire comprises a lamp enclosure including a reflector having an open end oriented generally downwardly, and a transparent closure made of a combustible polymeric material covering the open end. A high intensity discharge lamp is contained within the enclosure. The high intensity discharge lamp includes an arc tube and is subject to non-passive failure whereby hot debris such as particles of arc tube material fall on to an interior, upper surface of the lens. The interior, upper surface of the lens is ignition-resistant and, in exemplary embodiments, comprises a coating.

Quite surprisingly, very thin coatings of materials such as silicone hardcoat, or a combined coating of a silicon oxynitride having a composition $SiO_xN_y$ over a thin layer of silicone hardcoat, are highly effective. One expected result might be that a thin coating would serve as an oxygen barrier, and that a hot quartz particle would sink into the acrylic, but without an immediate flame. However, quite surprisingly, not only is there no flame, but hot debris particles do not sink into the acrylic. The quartz particles simply sit on top of the coated acrylic, and in some cases "dance" around, perhaps due to Leidenfrost phenomenon.

These very thin coatings do not adversely affect the optical characteristics of the lens and, in fact, can provide advantages such as scratch resistance and ultraviolet absorption. Lens thickness can be decreased, for a reduction in cost and an increase in light output.

DETAILED DESCRIPTION OF THE INVENTION

Figure 1:
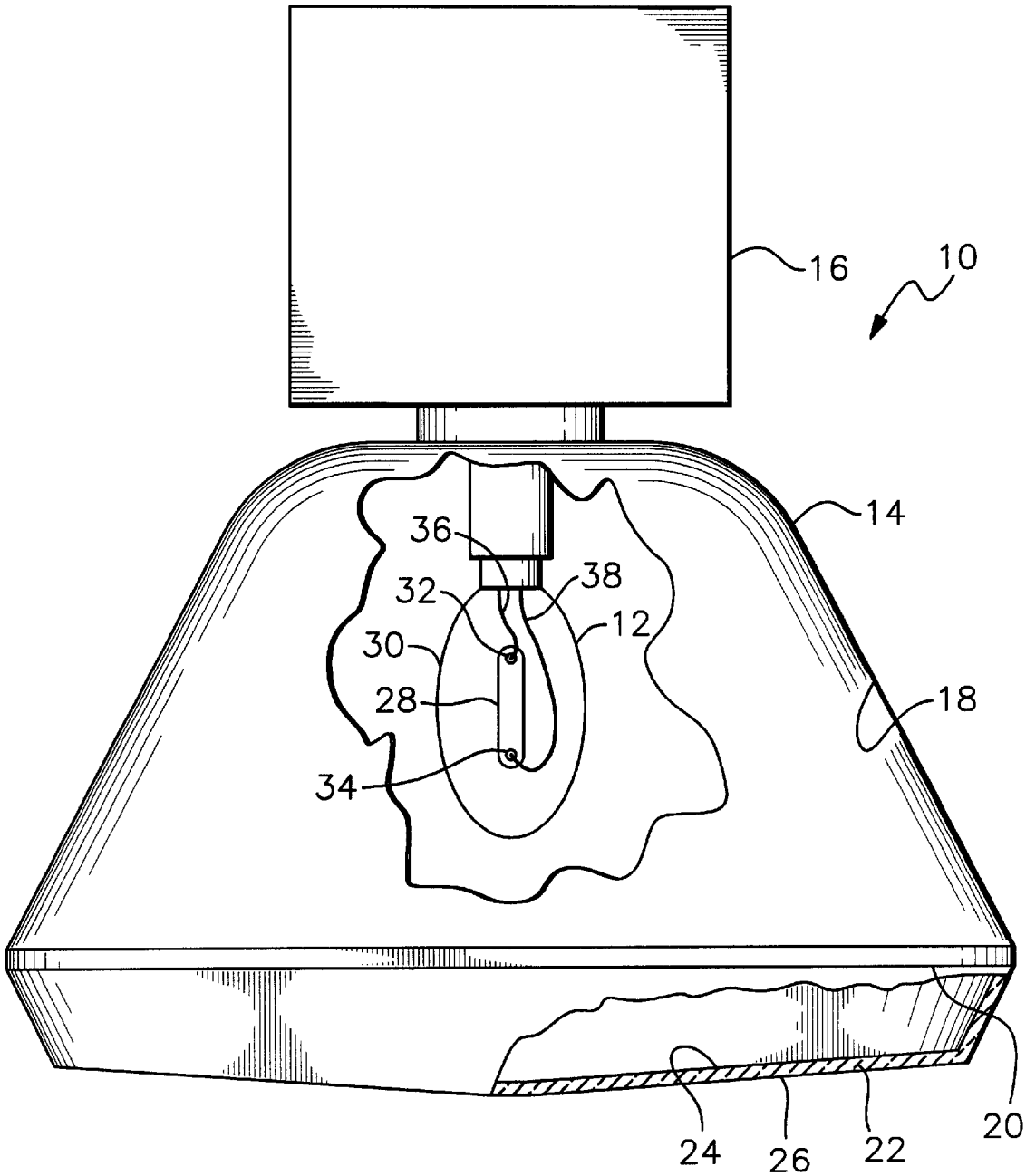
FIG. 1 is an elevational view, partially in section, of a luminaire embodying the invention.

Referring first to FIG. 1, a luminaire 10 includes a metal halide gas discharge lamp 12 within an enclosure, generally designated 14, and a ballast housing 16 containing conventional ballast circuitry for supplying electrical current to the lamp 12.

The enclosure 14 includes a reflector 18 having an open end 20 oriented generally downwardly, and a transparent closure 22 in the form of a lens 22 covering the open end 20. The lens 22 is made of a combustible transparent polymeric material, such as acrylic polymer, and has an upper, interior surface 24, and a lower, exterior surface 26. The lens 22 serves as a refractor, and accordingly, as is better seen in FIGS. 2–5 described hereinbelow, the lower surface 26, the upper surface 24, or both, is prismatic, to effect a desired pattern of light distribution.

The metal halide high intensity gas discharge lamp 12 includes an arc tube 28 within a transparent outer jacket 30. The arc tube 28 is made of quartz or ceramic, and contains a suitable fill, as well as a pair of tungsten electrodes 32 and 34 supplied with electrical current from circuitry within the ballast housing 16 via respective conductors 36 and 38. An arc is developed between the electrodes 32 and 34 during operation.

The high intensity discharge lamp 12 is subject to non-passive failure whereby hot debris in the form of hot (e.g. 1100° C.) particles of arc tube 28 material, electrode 32, 34 material, or both, fall on to the upper, interior surface 24 of the lens 22, resulting in potential ignition of the lens 22 material. Hot particles can even melt through, in the event the lens 22 is not sufficiently thick and does not embody the invention. Even when contained, the hot particles can cause unsightly damage to the lens 22, which may warrant replacement.

Figure 2:
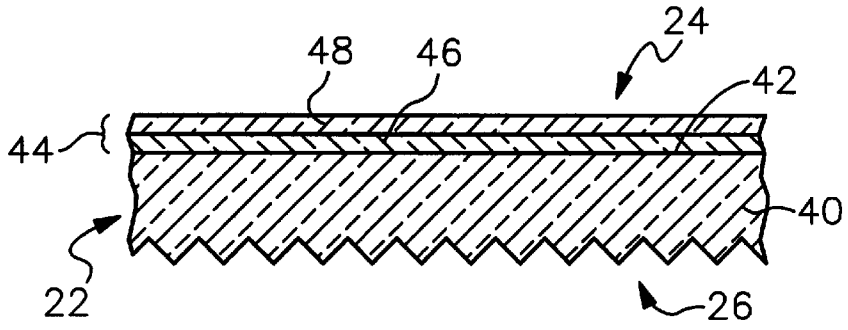
FIG. 2 is an enlarged cross-sectional view of a portion of the lens of FIG. 1, with a two-layer coating on the upper surface of the lens.

With reference now to FIG. 2, which is an enlarged cross-sectional view of a portion of the lens 22 of FIG. 1, the upper, interior surface 24 of the lens facing the lens 22 is ignition-resistant.

The lens 22 more particularly comprises a substrate 40 of combustible polymeric material, such as acrylic polymer, with a substrate interior surface 42. The upper, interior surface 24 comprises a non-ignitable coating 44 disposed on the substrate interior surface 42.

In the embodiment of FIG. 2, the coating 44 comprises a thin (e.g. 1 to 20 micron) underlayer 46, with or without an acrylic primer (not shown), followed by a thin (e.g. 1 to 20 micron) top layer 48 of a silicon oxynitride having a composition $SiO_xN_y$ where x is in the range between about 0.1 and 0.9, and y is in the range between about 0.1 and 0.9. A preferred thickness range for both the underlayer 46 and the top layer 48 is 5 to 10 microns.

The underlayer 46 serves several functions. One function is as a tie layer or interlayer 46 in view of the different coefficients of thermal expansion of the silicon oxynitride layer 48 and the acrylic polymer substrate 40 material. Another function is as an additional ignition-resistant layer 46. Yet another function is to provide a relatively smooth surface for the topcoat layer 48. A typical coating thickness for the underlayer 46 is 2 to 20 microns, but depends on the particular coating material.

The underlayer 46 coating can be composed of, but not limited to: metal oxide coatings from a sol-gel process such as silicone hardcoat; UV curable coatings based on acrylate and epoxy chemistry; thermally curable coatings based on silicone, polyurethane, or polyester chemistry; thermoplastic coatings of solvent-based or water-based types; coatings that contain dispersions of silica or metal oxides particles; and coatings that contain flame retardant additives.

The layer 46 of silicone hardcoat is directly applied to the upper surface 24 of the acrylic lens 22, with or without an acrylic resin primer, by any suitable process, such as flow coating, spray coating and dip coating. To form silicone hardcoat (SHC), methyl trimethoxysilane (MTMS) is mixed with aqueous colloidal silica to allow hydrolysis and polycondensation. Massive crosslinking among silane monomers and partially grafted colloidal silica results in extremely hard, glass-like, scratch resistant coatings for transparent plastic substrates. The primer for silicone hardcoat is either a solvent-based acrylic polymer solution, or a water-based acrylic polymer emulsion. A UV screener can be included.

The layer 48 of $SiO_xN_y$ can be formed by plasma enhanced chemical vapor deposition, which is a vacuum coating technology that provides high quality coatings. $SiO_xN_y$ coatings can be deposited using gas precursors, such as silane, ammonia and nitrous oxide. $SiO_xN_y$ has the advantage of relatively lower intrinsic stress ($1.91\times10^8$ dyne/cm$^2$) compared to other inorganic coatings, such as $SiO_2$ ($1.37\times10^9$ dyne/cm$^2$), and thus has better environmental durability.

Figure 3:
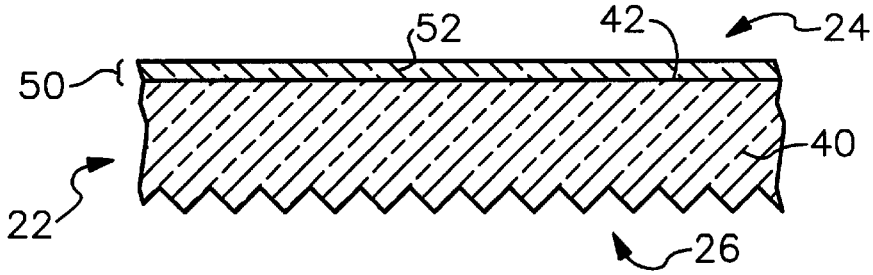
FIG. 3 is a similar enlarged cross-sectional view of a lens with a single-layer on the upper surface of the lens.

FIG. 3 depicts another embodiment of the invention, wherein the upper, interior surface 42 of the acrylic lens 22 substrate 40 has a coating 50 comprising a single layer 52 of silicone hardcoat, with or without an acrylic primer layer (not shown).

In the embodiment of FIG. 2, $SiO_xN_y$ is employed as the coating, in contrast to another inorganic coating such as $SiO_2$, because $SiO_xN_y$ coatings have much lower intrinsic stress compared to $SiO_2$ coatings. The silicone hardcoat layer 46 is employed as an interlayer in view of the different coefficients of thermal expansion of $SiO_xN_y$ and the acrylic lens 22. However, and with reference to FIG. 3, it was discovered that the single layer 52 of silicone hardcoat itself provided the advantages of the invention, with or without an acrylic primer. (The $SiO_xN_y$ layer 48 of FIG. 2 however provides additional scratch resistance.)

The coatings 44 and 50 of FIGS. 2 and 3 provide surprising containment qualities of both hot quartz particles pursuant to the test of UL 1572, as well as flame-retardant characteristics. With the lens 22 heated up to 88° C., and heated quartz particles at 1100° C. dropped on to the coating 44 or 50 comprising the upper surface 24 of the acrylic lens 22, not only is there no flame, but the particles do not sink substantially into the acrylic material of the lens 22. Thus, not only is effective containment provided but, in the event of a non-passive failure of the lamp 12, unsightly damage to the lens 22 is avoided and the luminaire 10 may be placed back into service while maintaining a good appearance, without requiring replacement of the lens 22.

Figure 4:
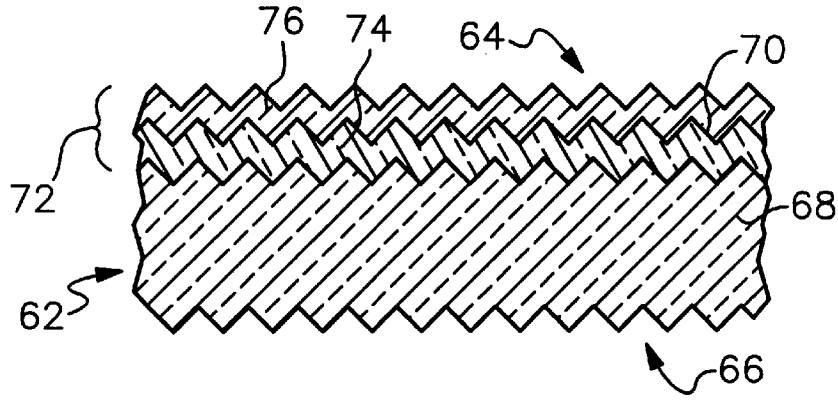
FIG. 4 is a cross-sectional view of an embodiment of the invention wherein an acrylic lens has prismatic upper and lower surfaces, and a two-layer coating over the upper surface.
Figure 5:
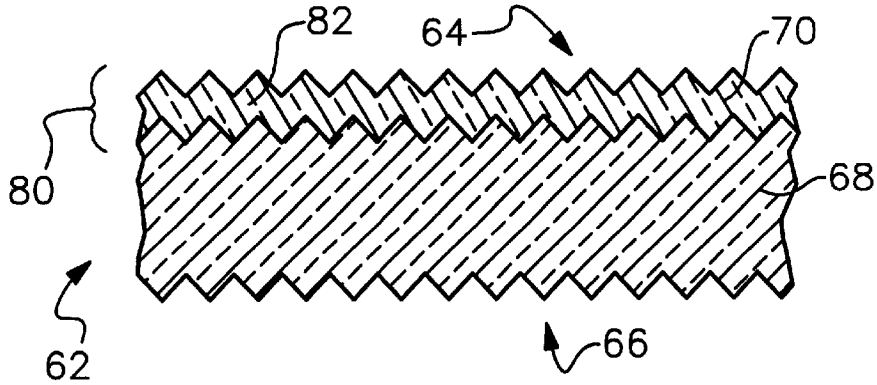
FIG. 5 is a cross-sectional view of an embodiment wherein a lens has prismatic upper and lower surfaces, and a single-layer coating over the upper surface.

FIGS. 4 and 5 correspond generally to FIGS. 2 and 3, respectively, and depict embodiments of the invention wherein an acrylic lens 62 has an upper, interior surface 64 which is prismatic to provide refractive qualities, as is the lower, exterior surface 66. The acrylic lens 62 comprises a substrate 68 of acrylic polymer, with a substrate interior surface 70 which is prismatic.

In the embodiment of FIG. 4, the upper interior surface 64 of lens 62 comprises a non-ignitable coating 72, which is substantially the same as the coating 44 of FIG. 2, comprising an interlayer 74 of silicone hardcoat, and an upper layer 76 of a silicon oxynitride. In the embodiment of FIG. 5, the upper interior surface 64 of lens 62 comprises a coating 80 which is substantially the same as the coating 50 of FIG. 3, comprising a single layer 82 of silicone hardcoat, with or without an acrylic primer (not shown). In both FIGS. 4 and 5, the respective coatings 72 and 80 follow the contour of the prismatic substrate interior surface 70.

The ignition-resistant interior surface 24 also permits a reduction in lens thickness. Thus the current 0.110 inch (2.794 mm) minimum lens thickness might be reduced to 0.060 inch (1.524 mm), as an example. The reduction in thickness can result in a cost saving, since less acrylic polymer is employed, as well as an increase in light output. Transparent closures embodying the invention can range in thickness from about 0.060 inch (1.524 mm) to 0.110 inch (2.794 mm).

EXAMPLE 1

Five acrylic lamp fixture samples were tested for industry standard flame-retardant performance (UL1572). The five samples were:

(A) 5–7 $\mu$m cured urethane acrylate coating/5.9 $\mu$m $SiO_xN_y$;

(B) 5–7 $\mu$m SHC without acrylic primer/5.9 $\mu$m $SiO_xN_y$;

(C) 5–7 $\mu$m urethane/acrylic coating/9.7 $\mu$m $SiO_xN_y$;

(D) 5–7 $\mu$m SHC with acrylic primer/9.7 $\mu$m $SiO_xN_y$;

(E) uncoated samples.

UV absorbers were not formulated into the silicone hardcoat, but can be incorporated. The samples were preheated to 88° C. using a quartz lamp heater and quartz particles were preheated to 1100° C. The 1100° C. quartz particles were then placed on the preheated acrylic samples and flame-retardant performance was visually evaluated. On uncoated acrylic surfaces, the pieces of quartz ignited the acrylic and partially or completely melted through. However, for all coated samples, the quartz particles did not stick to the surfaces and no burning was observed. Tests were also performed by preheating the samples to 110° C. Again, on uncoated acrylic surfaces, the pieces of quartz ignited the acrylic and partially or completely melted through. However, for all coated samples, the quartz particles did not stick to the surfaces and no burning was observed.

EXAMPLE 2

Three acrylic samples were tested for industry standard flame-retardant performance (UL1572). The samples were:

(A) 5–7 $\mu$m SHC with acrylic primer, (B) 5–7 $\mu$m SHC without acrylic primer, and (C) uncoated samples.

The sample size was roughly 7 inches×7 inches (17.78 cm×17.78 cm).

The samples were preheated to 88° C. using a quartz lamp heater, and quartz particles were preheated to 1100° C. The 1100° C. quartz particle was then placed on the preheated acrylic samples and flame-retardant performance was visually evaluated. The results showed that on uncoated acrylic surfaces the pieces of quartz ignited the acrylic and partially or completely melted through. However, for all coated samples, there were no flames, and virtually no melting of the acrylic. Tests were also performed by preheating the acrylic samples to 110° C. Again, on uncoated acrylic surfaces the pieces of quartz ignited the acrylic and partially or completely melted through. However, for all coated samples, there were no flames, and virtually no melting of the acrylic.

While the performance of the invention has been conclusively demonstrated, the mechanism is not fully understood. The non-ignitable coating serves as an oxygen barrier and, as such, would be expected to prevent ignition of the acrylic lens. However, as noted above, the beneficial effect of the invention is far greater. Not only is there no flame, but hot debris particles do not sink into the acrylic; they simply sit on top, and in some cases "dance" around. A coating material that evolves a gas when heated may enhance the effect.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A luminaire comprising:

a high-intensity gas discharge lamp subject to non-passive failure and thereby producing hot debris;

an enclosure for said lamp, said enclosure including an open end oriented generally downwardly, and a transparent closure made of a combustible polymeric material covering said open end, said transparent closure having an ignition-resistant interior surface facing said lamp, wherein said ignition-resistant interior surface includes a coating disposed on said interior surface, said coating being at least one of (i) a layer of silicone hardcoat or (ii) a layer of silicon oxynitride having a composition $SiO_xN_y$, with x in the range between about 0.1 and 0.9 and y in the range between about 0.1 and 0.09, and a silicone hardcoat layer is disposed between said interior surface and said silicon oxynitride layer; and wherein, in the event of non-passive lamp failure, said transparent closure contains the hot debris and said ignition-resistant interior surface fails to ignite when contacted by the hot debris.

2. The luminaire of claim 1, wherein said combustible polymeric material is an acrylic resin.

3. The luminaire of claim 2, wherein said transparent closure has a thickness between about 0.060 inch (1.524 mm) and 0.110 inch (2.794 mm).

4. The luminaire of claim 1, wherein said silicone hardcoat layer has a thickness of between about 1 micron and 20 microns.

5. The luminaire of claim 1, wherein said ignition-resistant interior surface further comprises an acrylic primer coating layer, said acrylic primer layer being disposed between said interior surface and said silicone hardcoat layer.

6. The luminaire of claim 1, wherein said silicon oxynitride layer has a thickness between about 1 micron and 20 microns.

7. The luminaire of claim 1, wherein said silicone hardcoat layer is applied by a method selected from the group consisting of flow coating, spray coating, and dip coating.

8. The luminaire of claim 1, wherein said silicone hardcoat layer further comprises a UV screener.

9. The luminaire of claim 1, wherein said silicon oxynitride coating layer is a vapor-deposited coating.

10. A transparent closure adapted to block hot debris produced by a non-passive failure of a high-intensity gas discharge lamp, said transparent closure comprising a lens made of a combustible polymeric material with an ignition-resistant coating disposed on a surface of said lens, said ignition-resistant coating including at least one of (i) a layer of silicone hardcoat, or (ii) a layer of silicon oxynitride having a composition $SiO_xN_y$ wherein x is in the range between 0.1 and 0.9 and y is in the range between 0.1 and 0.9.

11. The transparent closure of claim 10, wherein said polymeric material is an acrylic resin.

12. The transparent closure of claim 11, wherein said lens has a thickness between about 0.060 inch (1.524 cm) and 0.110 inch (2.794 mm).

13. The transparent closure of claim 10, wherein said silicone hardcoat layer has a thickness of between about 1 micron and 20 microns.

14. The transparent closure of claim 10, wherein said ignition-resistant coating further comprises a layer of an acrylic primer coating layer, said acrylic primer layer being disposed between said surface and said silicone hardcoat layer.

15. The transparent closure of claim 10, wherein said silicone hardcoat layer is disposed between said surface and said silicon oxynitride coating layer.

16. The transparent closure of claim 10, wherein said silicon oxynitride coating layer has a thickness between about 1 micron and 20 microns.

17. A method of making a transparent closure adapted to contain a debris produced by a non-passive failure of a high intensity gas discharge lamp, said method comprising the steps of:

providing a transparent lens formed from a polymeric material, applying an ignition-resistant coating to a surface of the transparent lens, wherein said ignition-resistant coating is at least one of a silicone hardcoat or a silicon oxynitride; and orienting the ignition-resistant coating toward the high intensity lamp, wherein, in the event of non-passive failure of the lamp, the transparent closure fails to ignite when contacted by hot debris.

18. The method of claim 17, wherein the step of applying a silicone hardcoat to the surface comprises flow coating the surface of the transparent lens.

19. The method of claim 17, wherein the step of applying a silicone hardcoat to the surface comprises spray coating the surface of the transparent lens.

20. The method of claim 17, wherein the step of applying a silicone hardcoat to the surface comprises dip coating the surface of the transparent lens.

21. The method of claim 17, which comprises applying the silicon oxynitride coating to the surface by chemical vapor deposition.

22. The method of claim 17, which comprises applying the silicon oxynitride coating to the surface by plasma enhanced chemical vapor deposition.

23. A luminaire comprising:

a metal halide gas discharge lamp subject to non-passive failure and thereby producing hot debris; and an enclosure for said lamp, said enclosure including an open end oriented generally downwardly, and a transparent closure made of a combustible polymeric material covering said open end, said transparent closure having an ignition-resistant interior surface facing said lamp;

wherein, in the event of non-passive lamp failure, said transparent closure contains the hot debris and said ignition-resistant interior surface fails to ignite when contacted by the hot debris.

24. The luminaire of claim 23, wherein said ignition-resistant interior surface comprises a coating disposed on said interior surface.

25. The luminaire of claim 23, wherein said combustible polymeric material is an acrylic resin.

26. The luminaire of claim 23, wherein said transparent closure has a thickness between about 0.060 inch (1.524 mm) and 0.110 inch (2.794 mm).

27. The luminaire of claim 24, wherein said ignition-resistant interior surface comprises a layer of silicone hardcoat.

28. The luminaire of claim 27, wherein said silicone hardcoat layer has a thickness of between about 1 micron and 20 microns.

29. The luminaire of claim 27, wherein said ignition-resistant interior surface further comprises an acrylic primer coating layer, said acrylic primer layer being disposed between said interior surface and said silicone hardcoat layer.

30. The luminaire of claim 27, wherein said ignition-resistant interior surface further comprises a silicon oxynitride coating layer having a composition $SiO_xN_y$, wherein x is in the range between about 0.1 and 0.9 and y is in the range between about 0.1 and 0.9, and wherein said silicone hardcoat layer is disposed between said inner lens surface and said silicon oxynitride coating layer.

31. The luminaire of claim 30, wherein said ignition-resistant interior surface further comprises a layer of an acrylic primer coating, said acrylic primer layer being disposed between said interior lens surface and said silicone hardcoat layer.

32. The luminaire of claim 24, wherein said ignition-resistant interior surface comprises a silicon oxynitride coating layer having a composition $SiO_xN_y$, wherein x is in the range between about 0.1 and 0.9 and y is in the range between about 0.1 and 0.9.

* * * * *